US008072401B2

(12) United States Patent
Lu et al.

(10) Patent No.: US 8,072,401 B2
(45) Date of Patent: Dec. 6, 2011

(54) ORGANIC LIGHT EMITTING DIODE DISPLAY AND RELATED PIXEL CIRCUIT

(75) Inventors: Hau-yan Lu, Hsin-Chu (TW); Chi-wen Chen, Hsin-Chu (TW); Ting-chang Chang, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 916 days.

(21) Appl. No.: 11/689,900

(22) Filed: Mar. 22, 2007

(65) Prior Publication Data

US 2008/0074360 A1 Mar. 27, 2008

(30) Foreign Application Priority Data

Sep. 22, 2006 (TW) ..... 95135284 A

(51) Int. Cl.
*G09G 3/32* (2006.01)

(52) U.S. Cl. ..... 345/82

(58) Field of Classification Search ..... 345/82, 345/77

See application file for complete search history.

(56) References Cited

U.S. PATENT DOCUMENTS

2003/0179626 A1 9/2003 Sanford et al.
2003/0227262 A1* 12/2003 Kwon ..... 315/169.3
2004/0007989 A1 1/2004 Li
2004/0178407 A1 9/2004 Lin
2004/0183758 A1 9/2004 Chen et al.
2005/0017934 A1 1/2005 Chung et al.
2005/0052377 A1 3/2005 Hsueh
2005/0237281 A1* 10/2005 Tam ..... 345/76
2006/0066532 A1* 3/2006 Jeong ..... 345/76

FOREIGN PATENT DOCUMENTS

TW 594628 B 6/2004
TW 230914 B 4/2005

* cited by examiner

*Primary Examiner* — Chanh Nguyen
*Assistant Examiner* — Tsegaye Seyoum

(57) ABSTRACT

A pixel circuit includes a first transistor coupled to a supply voltage end, a second transistor coupled to a ground end, a storage capacitor, a third transistor coupled to a data end, a fourth transistor, a fifth transistor coupled to the second transistor and the second end of the storage capacitor, and a light-emitting element coupled to the fourth transistor. The first transistor is used for conducting a supply voltage from the supply voltage end in response to a trigger of an enable signal. The second transistor is used for conducting a ground voltage from the ground end when a scan signal voltage is triggered. The storage capacitor includes a first end and a second end coupled to the first transistor and the second transistor, respectively. The third transistor is used for conducting a data signal voltage when the scan signal voltage is triggered. The fourth transistor is used for generating a conducting current based on the data signal voltage when the scan signal voltage is not triggered. The fifth transistor is used for forming a conducting route between the storage capacitor and the fifth transistor. The light-emitting element is used for generating light based on the conducting current of the fourth transistor.

2 Claims, 10 Drawing Sheets

ORGANIC LIGHT EMITTING DIODE DISPLAY AND RELATED PIXEL CIRCUIT

BACKGROUND OF THE INVENTION

1. Field of the Invention

The present invention relates to a pixel circuit for use in an organic light emitting diode (OLED) display, more particularly, to a pixel circuit capable of compensating luminance discrepancy for use in the OLED display.

2. Description of the Related Art

With a rapid development of monitor types, novelty and colorful monitors with high resolution, e.g., liquid crystal displays (LCDs), are indispensable components used in various electronic products such as monitors for notebook computers, personal digital assistants (PDA), digital cameras, and projectors. The demand for the novelty and colorful monitors has increased tremendously.

Liquid crystal display (LCD) monitors control pixel luminance by adjusting voltage drop applied on a liquid crystal layer of the liquid crystal display. Differing from liquid crystal displays (LCDs), Organic Light Emitting Displays (OLEDs) determine the pixel luminance by adjusting forward bias current flowing through an LED. With self-lighting technique without requiring additional light source electrode, OLEDs provide faster response time period than LCDs. In addition, OLEDs have the advantages of better contrast and wider visual angle. More important, OLEDs are capable of being manufactured by existing TFT-LCD process. The commonly used OLEDs utilize a low-temperature polysilicon thin film transistor (LTPS TFT) substrate or amorphous silicon (a-Si) substrate.

Please refer to FIG. 1, which shows a pixel circuit 10 of an OLED display according to a prior art. The pixel circuit 10 comprises a first transistor T1, a second transistor T2, a storage capacitor Cst, and an organic light emitting diode 12. When a scan signal voltage from a scan end SCAN to turn on the first transistor T1, the data signal voltage Vdata is fed from a data end DATA and is delivered to a gate electrode of the second transistor T2 via the first transistor T1. Whereon the second transistor T2 operating in a saturation region, a current Id is based on voltage drop between the source electrode and the gate electrode of the second transistor T2 ($Vsg=Vdd-Vdata$), in other words, $Id=K(Vsg-Vt)^2=K(Vdd-Vdata-Vt)^2$, where K is a constant, and Vt represents threshold voltage of the transistor T2. As the luminance of the OLED 12 is proportional to the current Id, thus is adjusted as the data signal voltage Vdata to show various grey levels. Moreover, the luminance of the OLED 12 can be shown a fixed gray level for a while because the data signal voltage Vdata is stored in the storage capacitor Cst.

Please refer to FIG. 2, which illustrates a relationship of the current Id versus display time under various threshold voltages. Currently with the conventional way for fabricating the OLED display employs Polysilicon Thin Film Transistor Circuit technology, it is possible that the second transistor T2 of each pixel circuit 10 on the OLED display may have different threshold voltage Vt. From the view of FIG. 2, obviously, the current Id of the second transistor T2 is varied as different threshold voltages. That will result in uneven luminance of the OLED display 12.

In addition, the current Id is also reduced as the voltage drop Vsg between the gate electrode and the source electrode caused by a decrease in the voltage Vdd due to load effect of line resistors. This phenomenon will degrade the display quality as well.

There is a need, therefore, for an improved OLED device and method for solving the problem of uneven luminance of the OLED panel resulting from the threshold voltage difference of the transistors, and a reduction of the conducting current flowing through the transistors attributed to a decrease in supply voltage Vdd due to line resistor.

SUMMARY OF THE INVENTION

An objective of the present invention is to provide a pixel circuit and an OLED display to solve the existing prior art problem.

In accordance with one embodiment, the claimed invention provides a pixel circuit. The pixel circuit comprises a first transistor coupled to a supply voltage end, a second transistor coupled to a ground end, a storage capacitor, a third transistor coupled to a data end, a fourth transistor, a fifth transistor coupled to the second transistor and the second end of the storage capacitor, and a light-emitting element coupled to the fourth transistor. The first transistor is used for conducting a supply voltage from the supply voltage end in response to a trigger of an enable signal. The second transistor is used for conducting a ground voltage from the ground end when a scan signal voltage is triggered. The storage capacitor comprises a first end and a second end coupled to the first transistor and the second transistor, respectively. The third transistor is used for conducting a data signal voltage when the scan signal voltage is triggered. The fourth transistor is used for generating a conducting current based on the data signal voltage when the scan signal voltage is not triggered. The fifth transistor is used for forming a conducting route between the storage capacitor and the fifth transistor. The light-emitting element is used for generating light based on the conducting current of the fourth transistor.

In accordance with another embodiment, the claimed invention provides an organic light emitting diode (OLED) display. The OLED display comprises a gate driver, a source electrode driver, and a plurality of pixel circuits. The gate driver is used for generating a scan signal voltage and an enable signal voltage. The source driver is used for generating a data signal voltage. Each pixel circuit comprises a first transistor coupled to a supply voltage end, a second transistor coupled to a ground end, a storage capacitor, a third transistor coupled to a data end, a fourth transistor, a fifth transistor coupled to the second transistor and the second end of the storage capacitor, and a light-emitting element coupled to the fourth transistor. The first transistor is used for conducting a supply voltage from the supply voltage end in response to a trigger of an enable signal. The second transistor is used for conducting a ground voltage from the ground end when a scan signal voltage is triggered. The storage capacitor comprises a first end and a second end coupled to the first transistor and the second transistor, respectively. The third transistor is used for conducting a data signal voltage when the scan signal voltage is triggered. The fourth transistor is used for generating a conducting current based on the data signal voltage when the scan signal voltage is not triggered. The fifth transistor is used for forming a conducting route between the storage capacitor and the fifth transistor. The light-emitting element is used for generating light based on the conducting current of the fourth transistor.

According to another embodiment of the present invention, the first transistor, the second transistor, and the third transistor are N-type metal-oxide semiconductor transistors. The fourth transistor and the fifth transistor are P-type metal-oxide semiconductor (MOS) transistors.

According to another embodiment of the claimed invention, the first transistor and the fifth transistor are N-type metal-oxide semiconductor (MOS) transistors, and the second transistor, the third transistor, and the fourth transistor are P-type metal-oxide semiconductor transistors.

According to another embodiment of the claimed invention, the first transistor, the second transistor, the third transistor, and the fourth transistor are P-type metal-oxide semiconductor transistors, and the fifth transistor is an N-type metal-oxide semiconductor transistor.

These and other objectives of the present invention will become apparent to those of ordinary skill in the art after reading the following detailed description of the preferred embodiment that is illustrated in the various figures and drawings.

DESCRIPTION OF THE PREFERRED EMBODIMENTS

Figure 3:
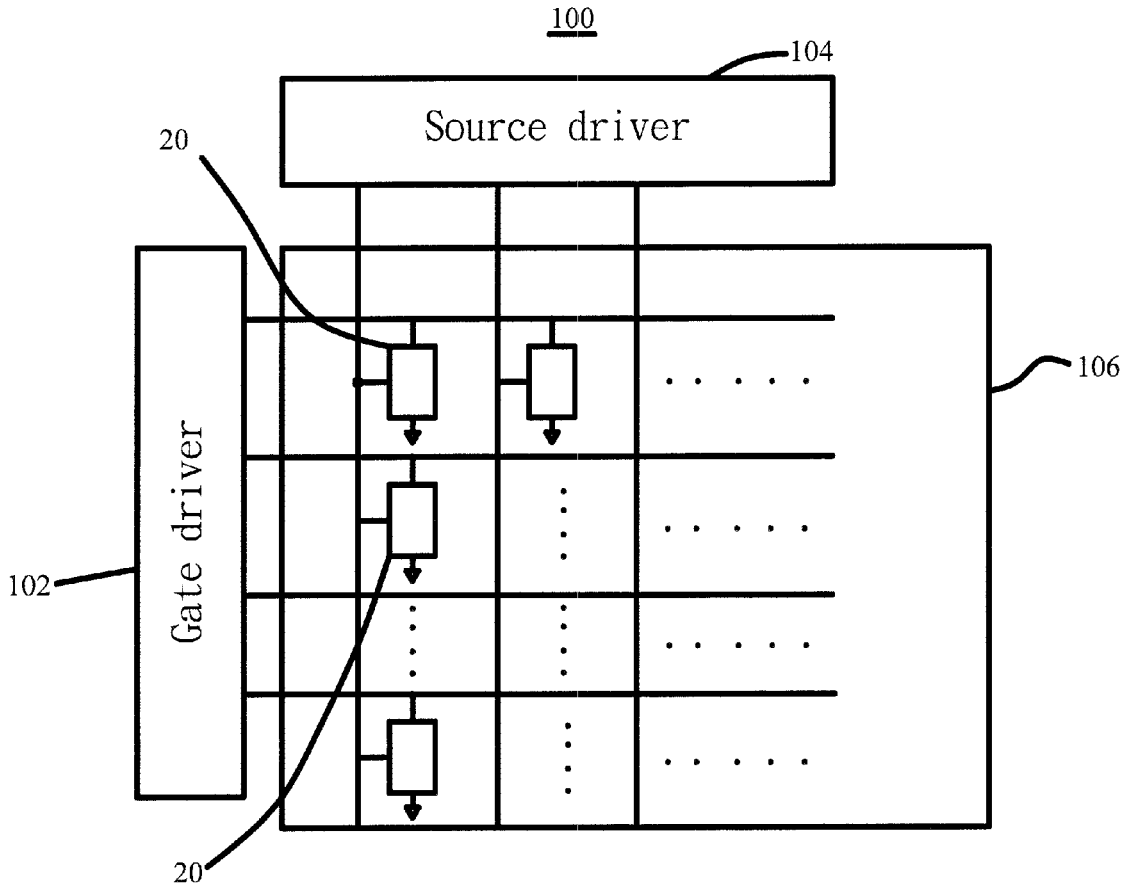
FIG. 3 illustrates a circuit diagram of an organic light emitting diode (OLED) display according to the present invention.

Please refer to FIG. 3. FIG. 3 illustrates an organic light emitting diode (OLED) display 100 according to the present invention, the OLED display 100 comprises a gate driver 102, a source driver 104, and a display area 106. The display area 106 comprises a plurality of pixel circuits 20 arranged in a matrix. The gate driver 102 generates an enable signal and a scan signal to switch on pixel circuits 20 row by row, so that pixel circuits 20 can display an image with various grey level based on the data signals generated by the source driver 104.

Figure 4:
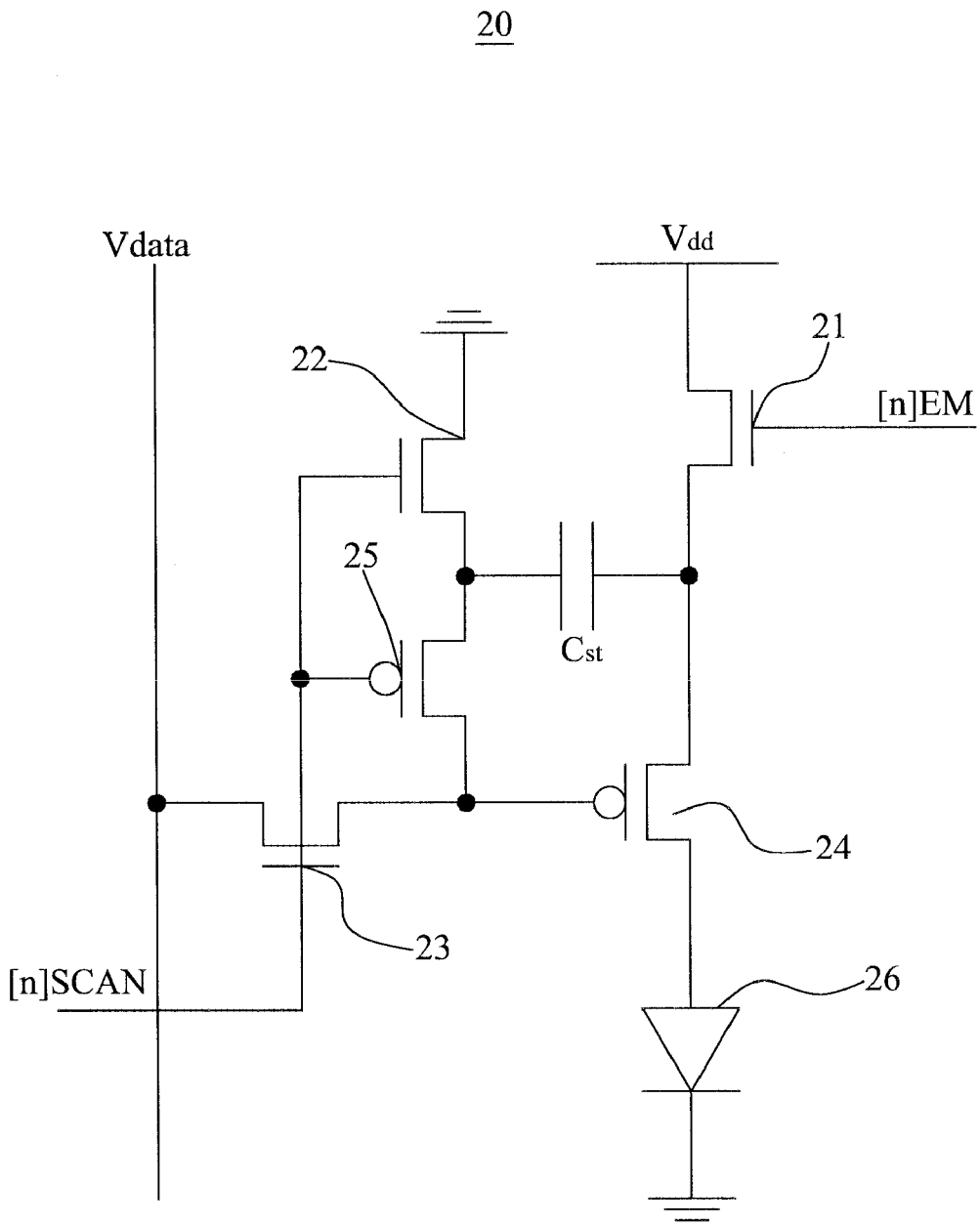
FIG. 4 shows a circuit diagram of a pixel circuit according to the first embodiment of the present invention.

Please refer to FIG. 4, which shows a circuit diagram of a pixel circuit 20 according to the first embodiment of the present invention. Each pixel circuit 20 comprises a first transistor 21, a second transistor 22, a third transistor 23, a fourth transistor 24, a fifth transistor 25, a storage capacitor Cst, and a light-emitting element 26. The first transistor 21, the second transistor 22, and the third transistor 23 are N-type metal-oxide semiconductor (MOS) transistors. The fourth transistor 24 and the fifth transistor 25 are P-type metal-oxide semiconductor (MOS) transistors. A gate electrode of the first transistor 21 is coupled to the enable end [n]EM which is coupled to the gate driver 102, and a drain electrode of the first transistor 21 is coupled to a supply end for providing a supply voltage Vdd. A gate electrode of the second transistor 22 is coupled to the scan end [n]SCAN which is coupled to the gate driver 102, and a source electrode of which is coupled to the ground end. A gate electrode of the fifth transistor 25 is also coupled to the scan end [n]SCAN, and a source electrode of the fifth transistor 25 is also coupled to a drain electrode of the second transistor 22. A gate electrode of the third transistor 23 is coupled to the scan end [n]SCAN as well, and a source electrode of the third transistor 23 is coupled to the data end DATA which is coupled to the source driver 104. A gate electrode of the fourth transistor 24 is coupled to the drain electrode of the fifth transistor 25 and the drain electrode of the third transistor 23, a source electrode of the fourth transistor 24 is coupled to the source electrode of the first transistor 21, and a drain electrode of the fourth transistor 24 is coupled to a light-emitting element 26. The storage capacitor Cst is coupled between the first transistor 21 and the second transistor 22. The light-emitting element 26, for example, an organic light emitting diode, utilizes current passing through organic thin-film material to generate light. The color of light emitted and the efficiency of the energy conversion from current to light are determined by the composition of the organic thin-film material.

Figure 5:
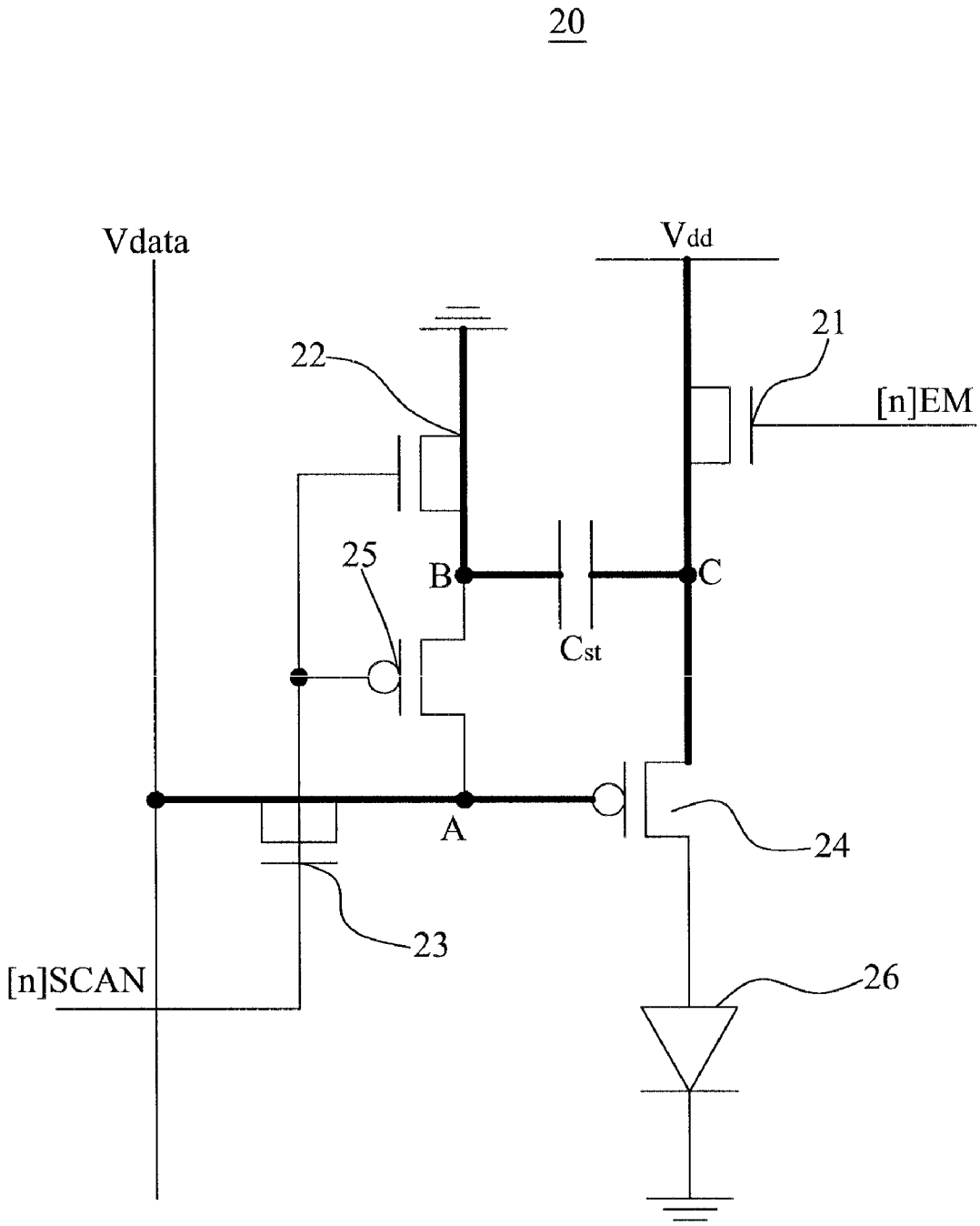
FIGS. 5-7 illustrate current-conducting states of the pixel circuit in various time periods.
Figure 6:
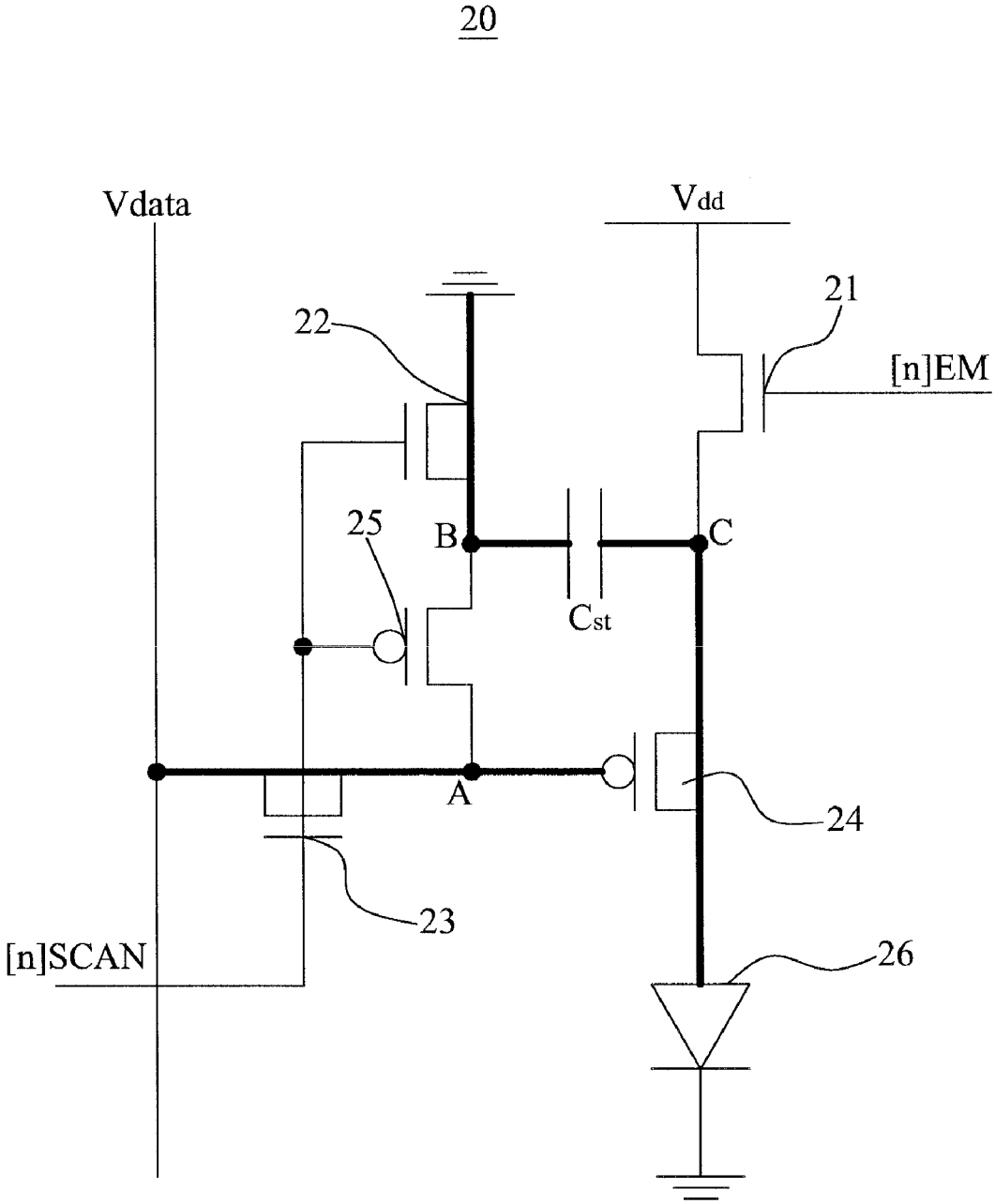
Figure 7:
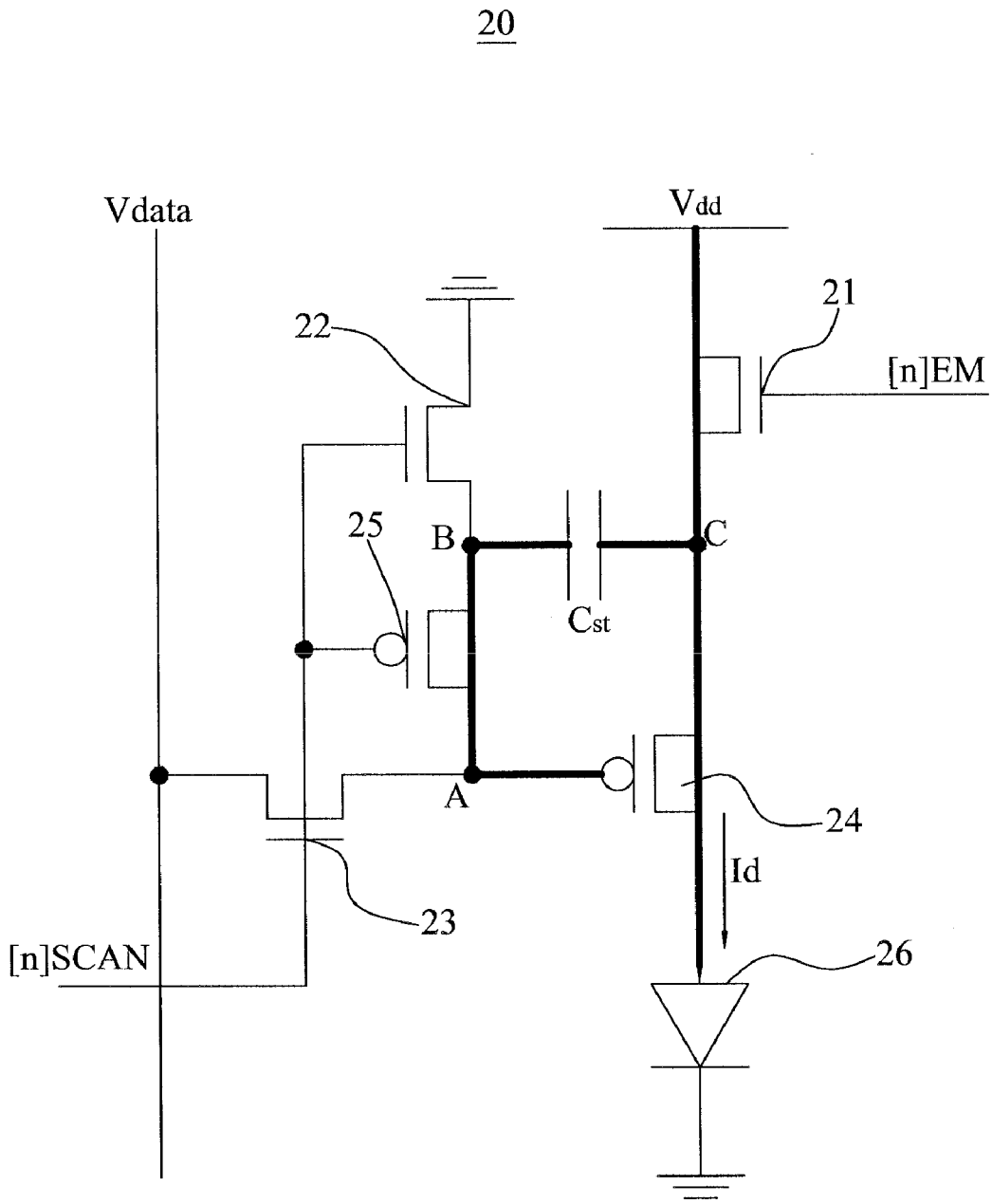
Figure 8:
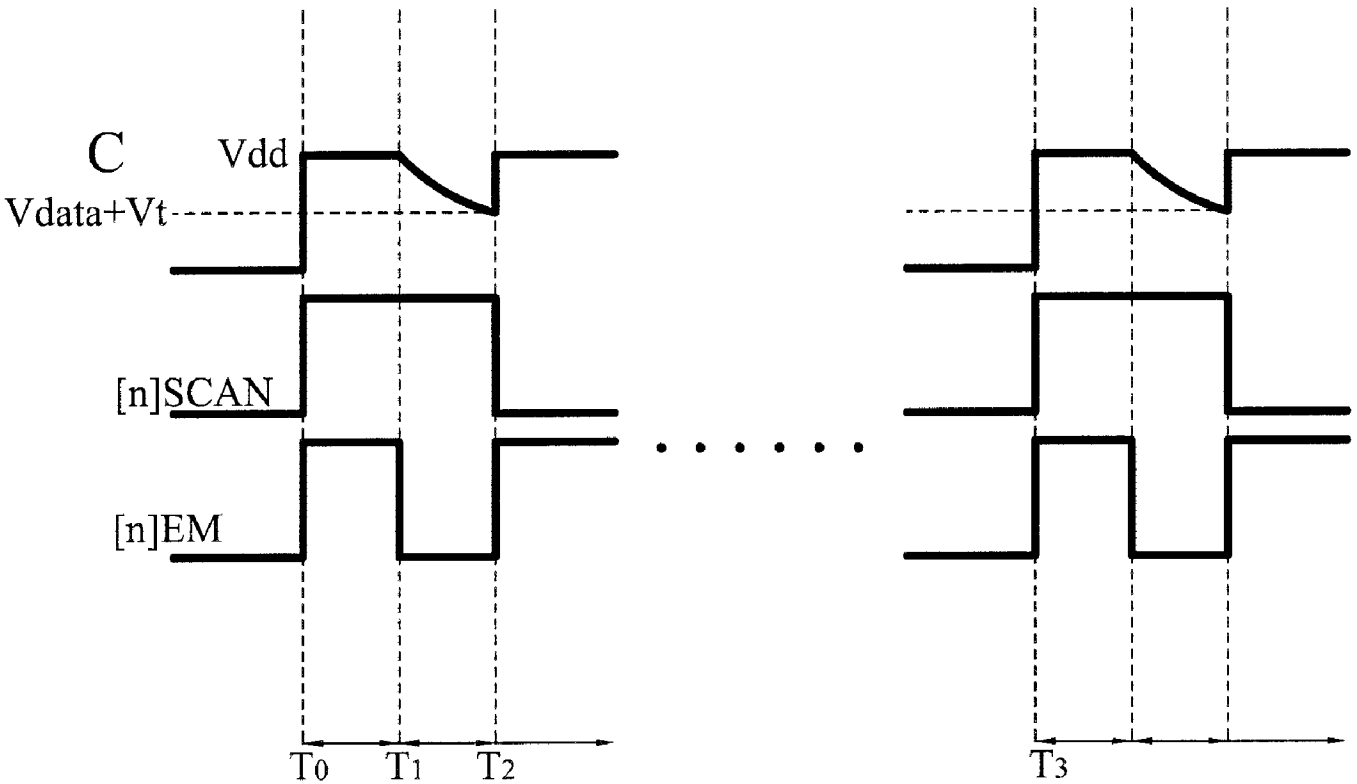
FIG. 8 is a timing diagram of the enable signal and the scan signal in display time period.

Please refer to FIGS. 5-8. FIGS. 5-7 illustrate current-conducting states of the pixel circuit 20 in various time periods. FIG. 8 is a timing diagram of the enable signal and the scan signal in display time period. In a time interval T0-T1 shown in FIG. 8, the first transistor 21 is turned on in response to a trigger of the enable signal from the enable end [n]EM, thereby a supply voltage Vdd is delivered to node C, meanwhile, the second transistor 22 and the third transistor 23 are turned on when a scan signal is triggered at the scan end [n]SCAN. A ground voltage GND is delivered to node B through the second transistor 22, and a data signal voltage Vdata is sent to the gate electrode of the fourth transistor 24 (i.e. node A) through the third transistor. The voltage across of the storage capacitor Cst equals to Vdd, whereas the fifth transistor 25 is turned-off.

Please refer to FIGS. 6 and 8. In a time period of T1-T2 shown in FIG. 8, the first transistor 21 is turned off, for no enable signal is triggered at the enable end [n]EM, while the second transistor 22 and the third transistor 23 are turned on, for the scan signal remains at the scan end [n]SCAN. At this moment, the fourth transistor 24 functions as a source electrode follower, such that the voltage at the node C drops to Vdata+Vt, where Vt represents the threshold voltage of the fourth transistor 24. The voltage across the storage capacitor Cst equals to Vdata+Vt accordingly.

Please refer to FIG. 7 and FIG. 8. After the time point T2 shown in FIG. 8, the first transistor 21 is turned on in response to a trigger of the enable signal at the enable end [n]EM, thereby causing the supply voltage Vdd to deliver to the node C, whereas the second transistor 22 and the third transistor 23 are turned off, for no scan signal pulse is present at the scan end[n]SCAN, yet, the fifth transistor 25 is turned on. Accordingly, the voltage at the node C is induced to the supply voltage Vdd due to turning on of the first transistor 21. At this moment, because an accumulated charge of the storage capacitor Cst remains, and the voltage across the storage capacitor Cst equals to Vdata+Vt soon, the voltage at the node B jumps to Vdd−Vdata−Vt accordingly. In the meantime, the voltage level at the node A is as similar as Vdd−Vdata−Vt on account of turning on the fifth transistor. In this way, the current Id through the fourth transistor 24 is expressed as:

$$Id=K(Vsg-Vt)^2=K(Vdd-(Vdd-V\text{data}-Vt)-Vt)^2=K(V\text{data})^2.$$

It is appreciated that the current Id through the fourth transistor 24 is relevant to the data signal voltage Vdata in the display time period (i.e. time interval T2-T3), instead of the threshold voltage Vt of the fourth transistor 24 and the supply voltage Vdd. As a result, the pixel circuit 20 according to this embodiment demonstrates that the current Id through the light-emitting element 26 only relates to the data signal voltage from the source driver 104, but is irrelevant to the threshold voltage Vt of the fourth transistor 24 and the supply voltage Vdd. In other words, the conventional problem of uneven luminance of the OLED display, attributed to a threshold voltage difference among the pixel circuits which is caused by the fabricating process, is solved.

Figure 1:
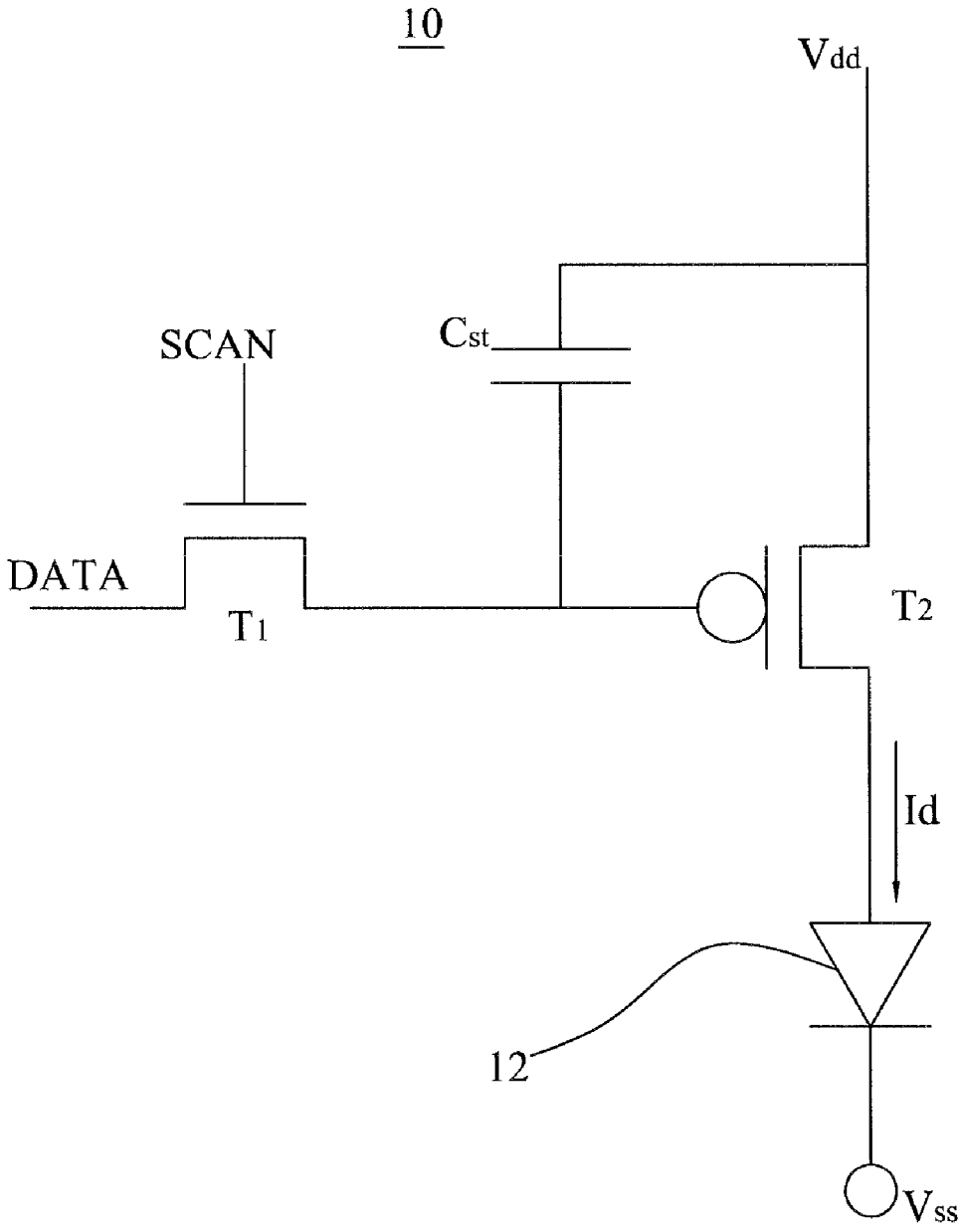
FIG. 1(PRIOR ART)
FIG. 1 shows a pixel circuit of an OLED display according to a prior art.
Figure 2:
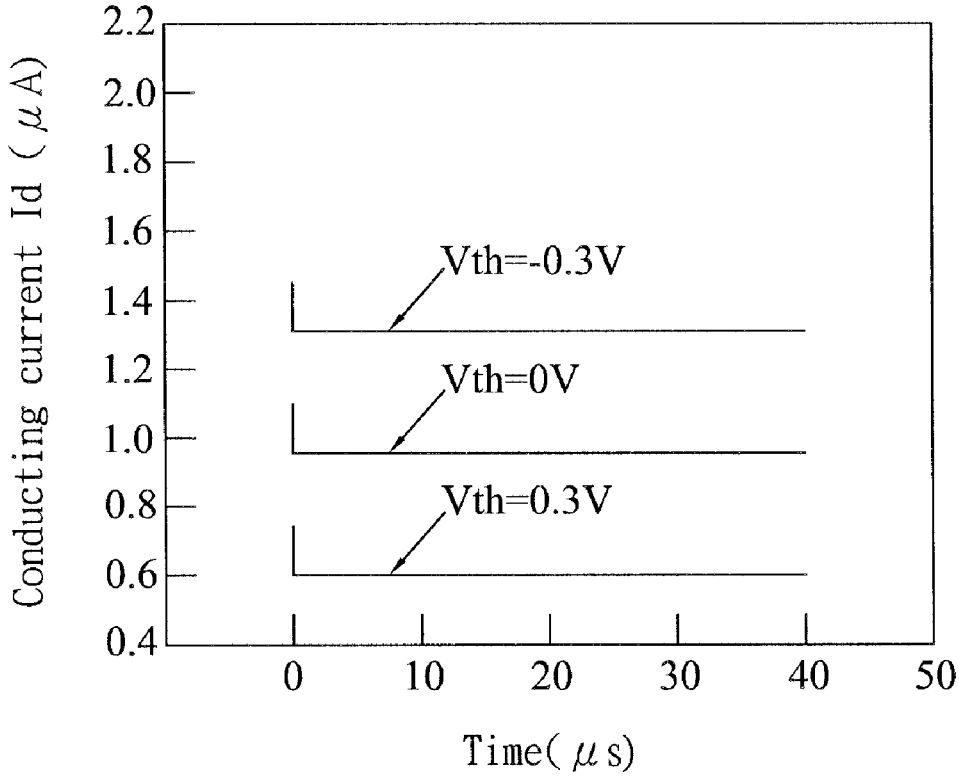
FIG. 2(PRIOR ART)
FIG. 2 illustrates a relationship of the current Id versus display time under various threshold voltages.
Figure 9:
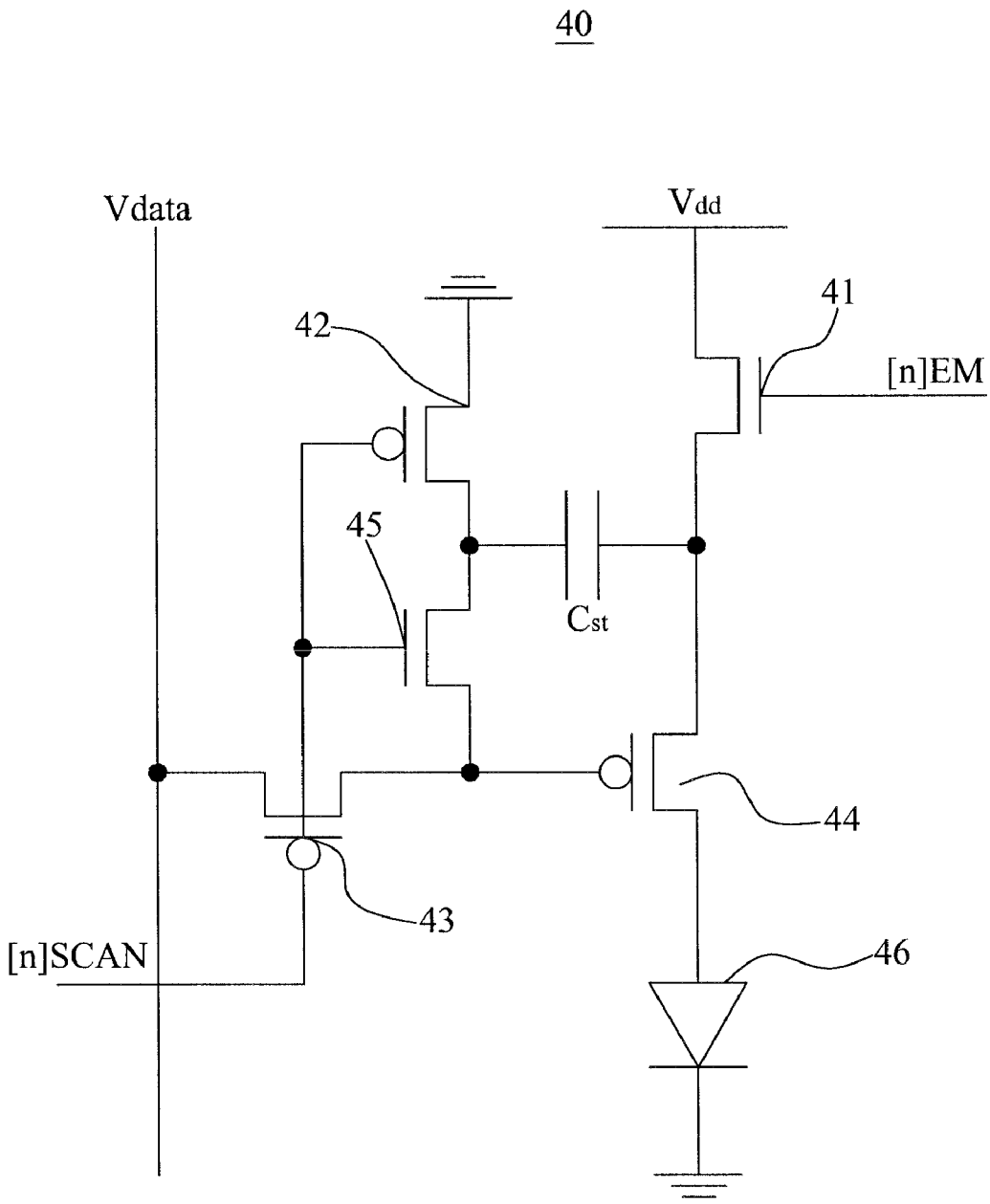
FIG. 9 illustrates a circuit diagram of a pixel circuit according to the second embodiment of the present invention.

Referring to FIG. 9 illustrating a circuit diagram of a pixel circuit 40 according to the second embodiment of the present invention, the pixel circuit pixel 40 comprises a first transistor 41, a second transistor 42, a third transistor 43, a fourth transistor 44, a fifth transistor 45, a storage capacitor Cst, and a light-emitting element 46. Different from the pixel circuit 20 depicted in FIG. 2, the first transistor 41 and the fifth transistor 45 are N-type metal-oxide semiconductor (MOS) transistors, and the second transistor 42, the third transistor 43, and the fourth transistor 44 are P-type metal-oxide semiconductor transistors. The light-emitting element 46, for example an organic light emitting diode, utilizes current passing through organic thin-film material to generate light. The operation principle of the pixel circuit 40 is similar to that of the pixel circuit 20 aforementioned, except a magnitude of the scan signal at the scan end [n]SCAN, so the operation principle of the pixel circuit 40 is omitted.

Figure 10:
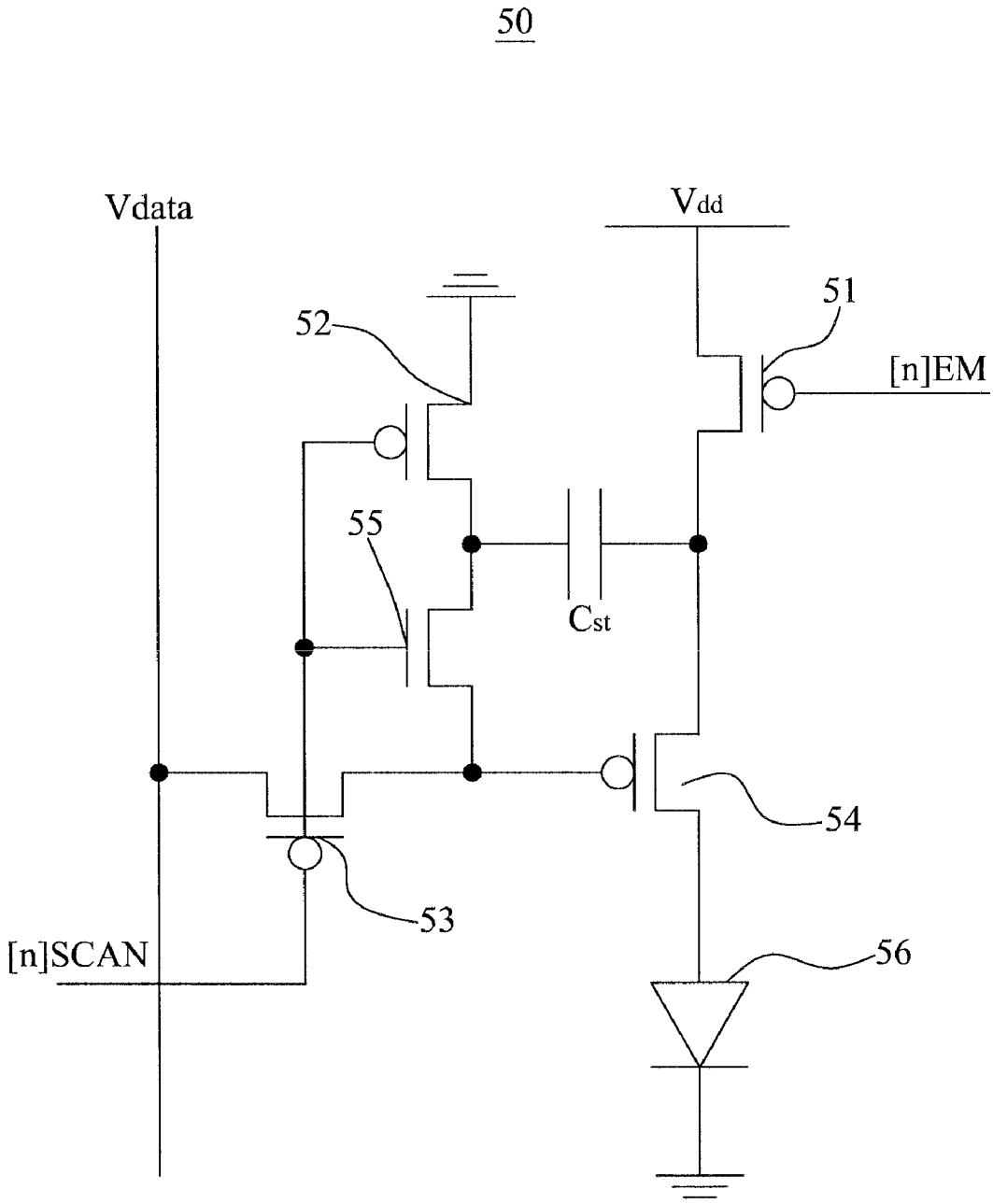
FIG. 10 illustrates a circuit diagram of a pixel circuit according to the third embodiment of the present invention.

With reference to FIG. 10 illustrating a circuit diagram of a pixel circuit 50 according to the third embodiment of the present invention, the pixel circuit 50 comprises a first transistor 51, a second transistor 52, a third transistor 53, a fourth transistor 54, a fifth transistor 55, a storage capacitor Cst, and a light-emitting element 56. The first transistor 51, the second transistor 52, the third transistor 53, and the fourth transistor 54 are P-type metal-oxide semiconductor transistors, and the fifth transistor 55 is an N-type metal-oxide semiconductor transistor. The light-emitting element 56, for example an organic light emitting diode, utilizes current passing through organic thin-film material to generate light. The operation principle of the pixel circuit 50 is similar to that of the pixel circuit 20 aforementioned, all except a magnitude of the scan signal at the scan end [n]SCAN, the operation principle of the pixel circuit 50, therefore, is omitted.

In contrast to prior arts, the present invention provides a pixel circuit of a light-emitting element which is capable of generate light based on its conducting current associated with the data signal voltage but irrelevant to the threshold voltage and the supply voltage. In this way, even though the panel is fabricated by using Polysilicon Thin Film Transistor Circuit technology, each light emitting element of the OLED panel can generate light based on the data signal voltage, thereby improving the uneven luminance of the OLED panel attributed to threshold voltage difference of the transistors, and overcoming a reduction of the conducting current flowing through the transistor attributed to a decrease in supply voltage Vdd due to line resistor.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A pixel circuit comprising:

a voltage supply;

a first transistor, electrically coupled to the voltage supply, for conducting a supply voltage from the voltage supply in response to an enable signal;

a second transistor, electrically coupled to a ground end and a scan line, for conducting a ground voltage from the ground end when a scan signal voltage from the scan line is triggered;

a storage capacitor having a first end and a second end electrically coupled to the first transistor and the second transistor, respectively;

a third transistor, comprising a first end electrically coupled to a data line, a control end electrically coupled to the scan line, and a second end, for conducting a data signal voltage from the data line when the scan signal voltage from the scan line is triggered;

a fourth transistor, comprising a first end electrically coupled to the first transistor, a control end electrically coupled to the second end of the third transistor, and a second end, for generating a conducting current based on the data signal voltage when the scan signal voltage is not triggered a fifth transistor, comprising a first end electrically coupled to the control end of the fourth transistor and the second end of the third transistor, a control end electrically coupled to the scan line, and a second end electrically coupled to the second end of the storage capacitor, for forming a conducting route between the storage capacitor and the fifth transistor when the scan signal voltage from the scan line is not triggered; and a light-emitting element, electrically coupled to the second end of the fourth transistor, for generating light based on the conducting current of the fourth transistor.

2. An organic light emitting diode (OLED) display, comprising:

a gate driver, for generating a scan signal voltage and an enable signal voltage;

a source driver, for generating a data signal voltage; and a plurality of pixel circuits, each pixel circuit comprising:

a voltage supply;

a first transistor, electrically coupled to the voltage supply, for conducting a supply voltage from the voltage supply in response to an enable signal;

a second transistor, electrically coupled to a round end and the source driver for conducting a ground voltage from the ground end when a scan signal voltage from the source driver is triggered a storage capacitor having a first end and a second end electrically coupled to the first transistor and the second transistor, respectively;

a third transistor, comprising a first end electrically coupled to a gate driver, a control end electrically coupled to the scan line, and a second end, for conducting a data signal voltage from the data line when the scan signal voltage from the scan line is triggered;

a fourth transistor, comprising a first end electrically coupled to the first transistor, a control end electrically coupled to the second end of the third transistor, and a second end, for generating a conducting current based on the data signal voltage when the scan signal voltage is not triggered;

a fifth transistor, comprising a first end electrically coupled to the control end of the fourth transistor and the second end of the third transistor, a control end electrically coupled to the scan line, and a second end electrically coupled to the second end of the storage capacitor, for forming a conducting route between the storage capacitor and the fifth transistor when the scan signal voltage from the scan line is not triggered and a light-emitting element, electrically coupled to the second end of the fourth transistor, for generating light based on the conducting current of the fourth transistor.

* * * * *